US005697318A

United States Patent [19]

Kobayashi

[11] Patent Number: 5,697,318

[45] Date of Patent: Dec. 16, 1997

[54] SEATING AND CONTROL ARRANGEMENT FOR SMALL WATERCRAFT

[75] Inventor: Noboru Kobayashi, Iwata, Japan

[73] Assignee: Yamaha Hatsudoki Kabushiki Kaisha, Iwata, Japan

[21] Appl. No.: 575,251

[22] Filed: Dec. 20, 1995

[30] Foreign Application Priority Data

Dec. 20, 1994 [JP] Japan ..... 6-317132

[51] Int. Cl.[6] ..... B63B 17/00

[52] U.S. Cl. ..... 114/343; 114/362; 114/363; 114/364

[58] Field of Search ..... 114/343, 362, 114/363, 364, 270; 296/71

[56] References Cited

U.S. PATENT DOCUMENTS

| | | | |
|---|---|---|---|
| 3,428,976 | 2/1969 | Robinson | 114/363 |
| 3,839,757 | 10/1974 | Grimes | 114/363 |
| 4,566,734 | 1/1986 | Bruner | 114/363 |
| 4,712,503 | 12/1987 | Ritten | 114/343 |
| 4,754,724 | 7/1988 | Murakami | 114/363 |
| 4,945,853 | 8/1990 | Lathers | 114/363 |
| 5,131,346 | 7/1992 | Ohta et al. | 114/363 |
| 5,399,111 | 3/1995 | Kobayashi et al. | 114/270 |

FOREIGN PATENT DOCUMENTS

| | | | |
|---|---|---|---|
| 15231 | 1/1985 | Japan | 296/71 |
| 403262792 | 11/1991 | Japan | 114/270 |

*Primary Examiner*—Sherman Basinger

*Attorney, Agent, or Firm*—Knobbe, Martens, Olson & Bear LLP

[57] ABSTRACT

A small watercraft passenger compartment, control and seating arrangement. The passengers' compartment is relatively small and a control is disposed in association with a seat so that the seat may be positioned either behind the control for seated operation or to the side of the control so that an operator can stand behind the control. This facilitates boarding and also permits the operator to be at an optimum position if he desires to operate the watercraft in either the seated or standing conditions.

20 Claims, 6 Drawing Sheets

SEATING AND CONTROL ARRANGEMENT FOR SMALL WATERCRAFT

BACKGROUND OF THE INVENTION

This invention relates to a small watercraft and more particularly to an improved seating and control arrangement for such watercraft.

There is a very popular type of watercraft which is commonly referred to as a "personal watercraft." This type of watercraft generally is very sporting in nature and is configured with a relatively small passengers' compartment in which one rider and occasionally one or more passengers may be accommodated. In one type of arrangement of this nature, a straddle-type seat is provided in which the operator sits in a straddle position behind the control for operating the control. Additional passengers may be accommodated in tandem, straddle fashion behind the rider, operator.

The described type of watercraft is generally configured in such a way that the foot areas on the side of the seat and possibly a deck area to the rear of the seat is open through the transom of the watercraft. This open transom configuration permits the rider and/or passengers to enter the watercraft from the body of water in which the watercraft is operating easily.

This open transom arrangement, however, affords little protection for the riders. Particularly, when the watercraft is being operated at a high speed and then is suddenly slowed, the water may easily move up into the foot areas and flood them at least temporarily.

Another type of personal watercraft is provided with a pivoted mast and the rider generally operates the watercraft in a standing fashion. Obviously, this type of watercraft is quite sporting in nature but the operator may easily become tired. There have been provided watercraft wherein a seat for such an operator is provided but these type of watercraft do not necessarily provide optimum positions for the rider, operator in either standing or seated positions.

With this type of watercraft, only the rider, operator can be accommodated. There are times, however, when it may be desirable to also accommodate a standing passenger in addition to the operator. However if this is done it is also desirable to keep the watercraft small so that the sporting nature is not lost.

It is, therefore, a principle object of this invention to provide a small watercraft that can accommodate two passengers standing in side by side relation.

With such a watercraft it is also desirable that either the passenger and/or the operator may be seated at times.

It may be possible to afford more protection for the rider and a seating accommodation that will be more comfortable if the rear of the riders' area is enclosed by an upstanding wall. If this is done, however, then the rider may have difficulty entering into the riders' area. That is, with this arrangement there is very little floor space provided in front of the seat and frequently the small floor space that is available is obscured by the control.

It is, therefore, a further object of this invention to provide an improved passenger compartment arrangement for such a small watercraft.

It is a further object of this invention to provide an improved control and seating arrangement for a small watercraft that facilitates boarding and also which permits the rider to operate the watercraft in either a standing or seated fashion with each position being comfortable and providing the necessary control and visibility.

SUMMARY OF THE INVENTION

A first feature of this invention is adapted to de embodied in a small watercraft having a hull defining a riders, area. A watercraft control is located at one side of and to the front of the riders' area for operation of the watercraft by a standing rider to the rear of the control. A grab rail is located at the front of the riders' area to permit a passenger to stand next to the rider and grasp the hand rail.

Another feature of this invention is adapted to be embodied in a small watercraft that is comprised of a hull defining a generally open riders' area that is surrounded on at least three sides by an upstanding wall with the floor of the riders' area disposed substantially below the upper end of the wall. A control for the watercraft extends into the riders' area and a seat is also provided in the riders' area. The seat is movable between a first position which is disposed to the rear of the control for operation of the watercraft by an operator seated on the seat and a second position which is space transversely from the area behind the control so that a rider may stand in the area behind the control.

DETAILED DESCRIPTION OF THE PREFERRED EMBODIMENTS

Figure 1:
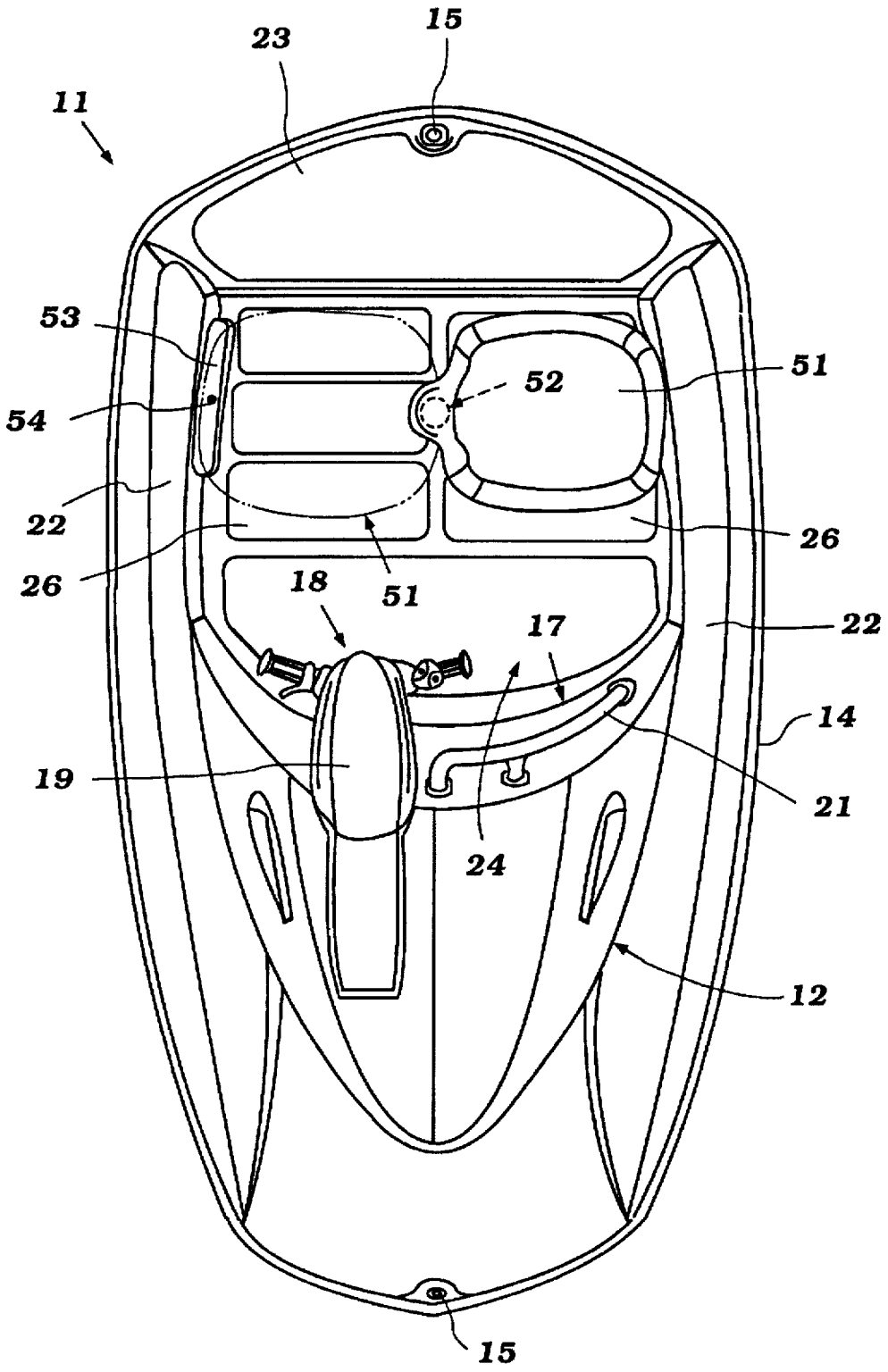
FIG. 1 is a top plan view of a personal watercraft constructed in accordance with an embodiment of the invention showing the seat in one of its positions in solid lines and in its other position in phantom.
Figure 2:
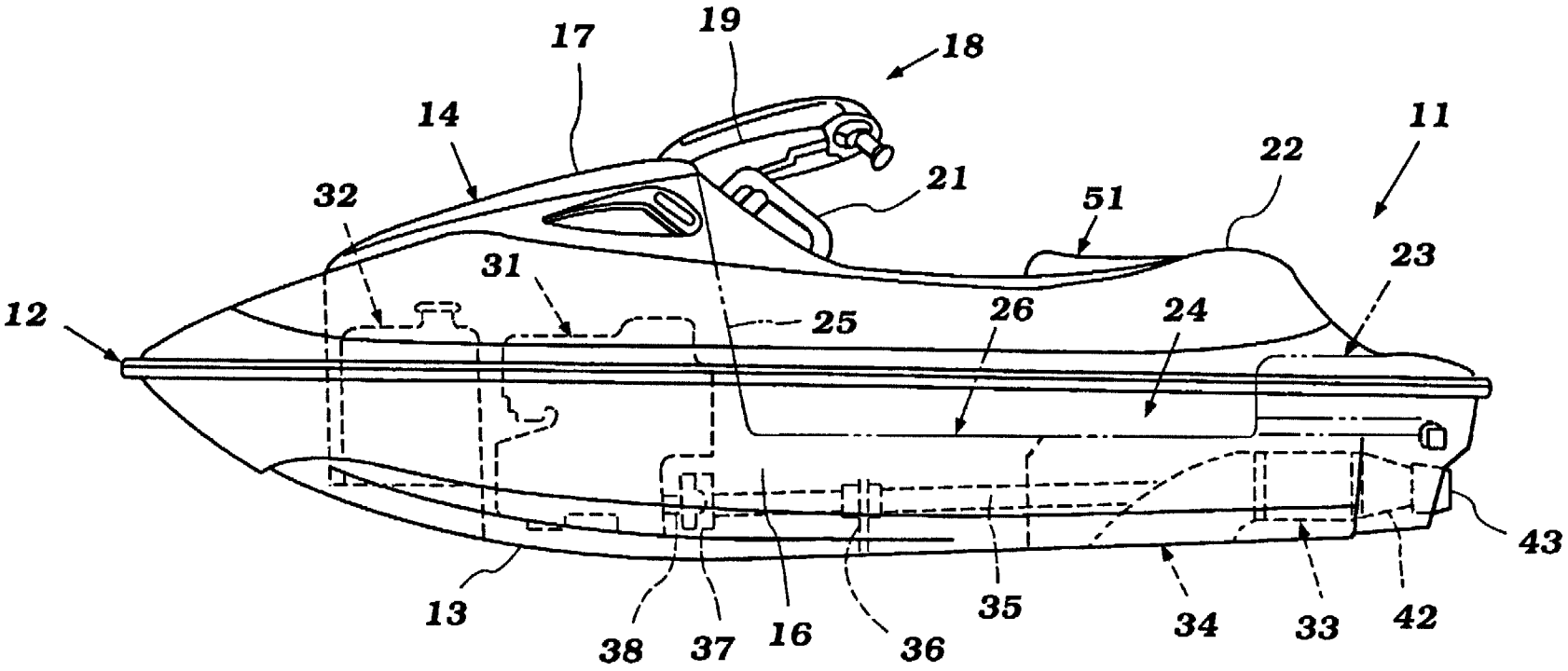
FIG. 2 is a side elevational view thereof.
Figure 3:
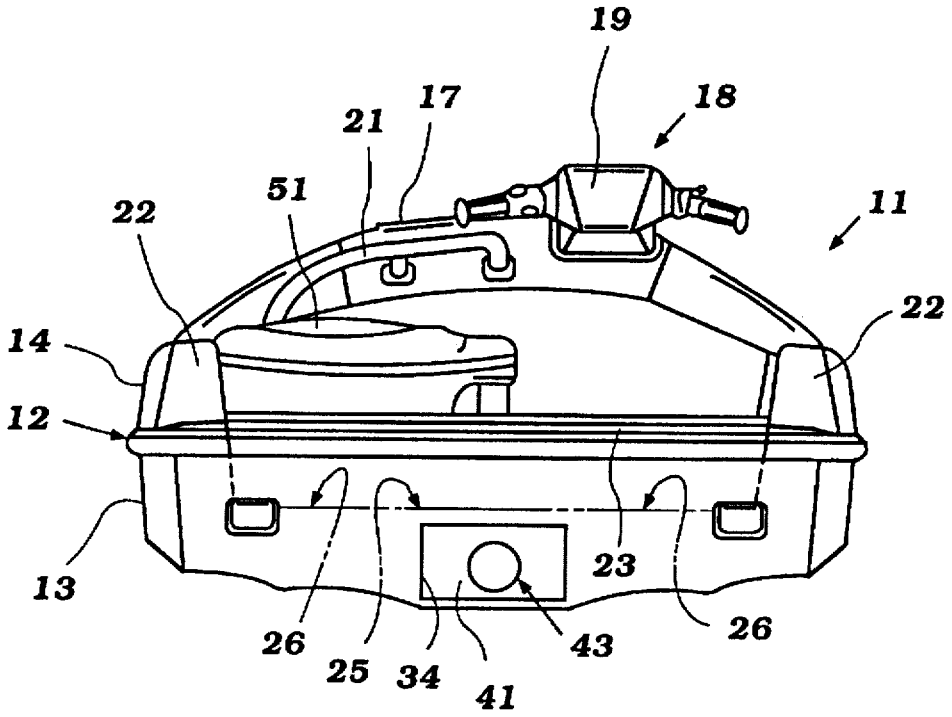
FIG. 3 is a rear elevational view thereof.

Referring now in detail to the drawings and initially to FIGS. 1, 2 and 3, a personal watercraft constructed in accordance with an embodiment of this invention is identified generally by reference numeral 11. The watercraft 11 is comprised of a hull indicated generally by reference numeral 12 and comprised primarily of a lower hull 13 and an upper deck 14 which may be formed from any suitable material such as a molded, fiberglass reinforced, resinous plastic or the like. The lower hull 13 sealingly engages the upper deck 14 around its periphery in any suitable manner and is fixed in position by any suitable means. Tie downs 15 are provided at the bow and stern of the hull 12. The hull 12 defines an engine compartment indicated generally by the reference numeral 16.

The upper deck 14 also has an upstanding console portion 17 through which a control assembly 18 consisting of a steering handlebar or mast assembly 19 that is pivotally journaled through the console 17 to the upper deck 14 for up and down pivotal movement about a generally horizontal axis in a suitable manner to allow either standing or sitting control, as will become apparent. The control assembly also contains the throttle and ignition controls. Additionally, a grab rail 21 is attached to the rear of the console 17 on the side opposite of the control assembly 18. This grab rail 21 permits a passenger to stand on this side by grasping the rail 21.

A pair of raised gunnels 22 are formed along opposite sides of the rear portion of the upper deck 14 and extend forwardly while gradually blending into the contour of the upper deck 14 at the bow of the watercraft 11. The gunnels 22 terminate at the rearward ends at a deck area 23 which forms a step at the rear of the watercraft 11 and permits ease of entering and exiting of the watercraft from the body of water in which the watercraft is operating. The deck area 23 is formed to the rear of an upstanding wall at the rear of a riders' area 24 and also prevents the flow of water from the operating environment over the rearward end of the upper deck 14 which would normally occur under such circumstances as when the watercraft 11 decelerates rapidly or when a passenger is present in addition to the rider of the watercraft 11.

The rider's area 24 is recessed and is disposed in the upper deck 14. The riders' area comprises the area enclosed by the deck area 23 at the rear, gunnels 22 along the sides and the engine compartment rear wall 25 at the front respectively, whose respective inner surfaces define upstanding walls at whose lower ends is disposed a floor 26 which is substantially below the upper ends of the upstanding walls. Accommodations are provided in the rider's area 24 for one or more riders positioned side-by-side in a manner that is to be described in detail later.

An engine 31 is disposed in the engine compartment 16 forward of the engine compartment rear wall 25 and beneath the upstanding console portion 17 of the upper deck 14. Fuel is supplied to the engine 31 by a fuel tank 32 disposed in the front of the engine 31 at the most forward portion of the engine compartment 16.

The engine 31 has an exhaust system (not shown) which exhausts the combustion products and the engine cooling water from the engine water jackets to the atmosphere in any known manner. The engine 31 drives a jet propulsion unit 33. A tunnel 34 is formed on the underside of the lower hull portion 13 at its rearward end. The tunnel 34 opens through the rear of the watercraft 11 under the deck area 23 as is clearly shown in FIG. 2.

The jet propulsion unit 33 is mounted within the tunnel 34 for propelling the watercraft 11. The jet propulsion unit includes an impeller (not shown) which draws water from the body of water in which the watercraft 11 is operating. The impeller is affixed to an impeller shaft 35 which extends forwardly through a bulkhead 36 from the tunnel 34 into the engine compartment 16. The impeller shaft 35 is coupled by means of a flexible coupling 37 to an engine output shaft 38 for driving the impeller.

Water pumped by the impeller is discharged rearwardly through an opening 41 formed at the rear of the tunnel 34 below the deck area 23 through a discharge nozzle portion 42 of the jet propulsion unit 33. A pivotally supported steering nozzle 43 is supported in .registry with the discharge nozzle 42 and is steered by the control assembly 18 for steering of the watercraft 11 in a well known manner.

Figure 6:
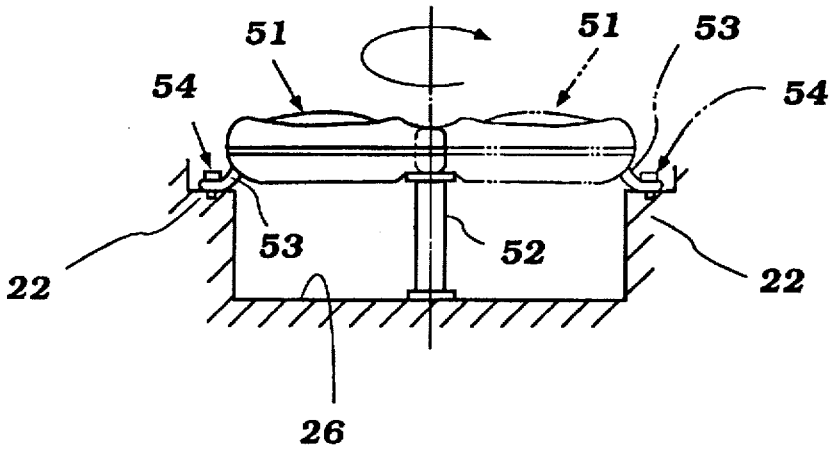
FIG. 6 is a rear elevational view of another embodiment of the invention showing a partial cross-section of the rearward portion of the watercraft and illustrating how the seat may be moved between its two positions.
Figure 7:
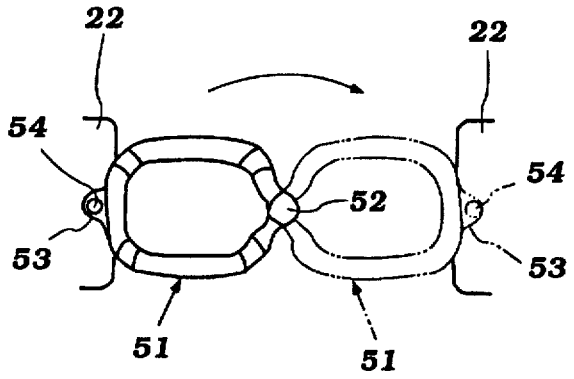
FIG. 7 is a top plan view of the embodiment of FIG. 6.

Referring now in detail to the rider's area 24 and with initial reference to FIGS. 1 and 6, a seat 51 is provided for the rider and is pivotally journaled to a mast 52 which is, in turn, rigidly affixed to the floor 26 of the riders area 24. The seat 51 may be rigidly supported at its outer edge upon the upstanding wall portion of either the starboard or port gunnels 22 as shown in the embodiment of FIGS. 1 through 5 or by means of a mounting bracket 53 that is affixed to the seat 51 and through which passes a bolt 54 that threadingly engages the desired gunnel 22 as shown in the embodiment of FIGS. 6 and 7.

Figure 4:
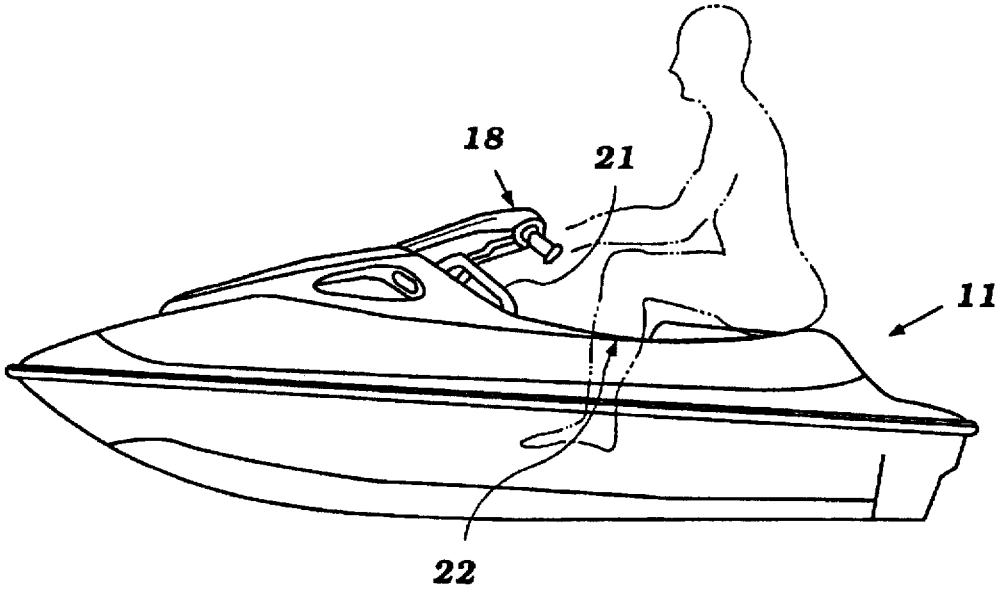
FIG. 4 is a side elevational view of the personal watercraft constructed in accordance with the first embodiment of the invention with a rider shown in a seated operating position.
Figure 5:
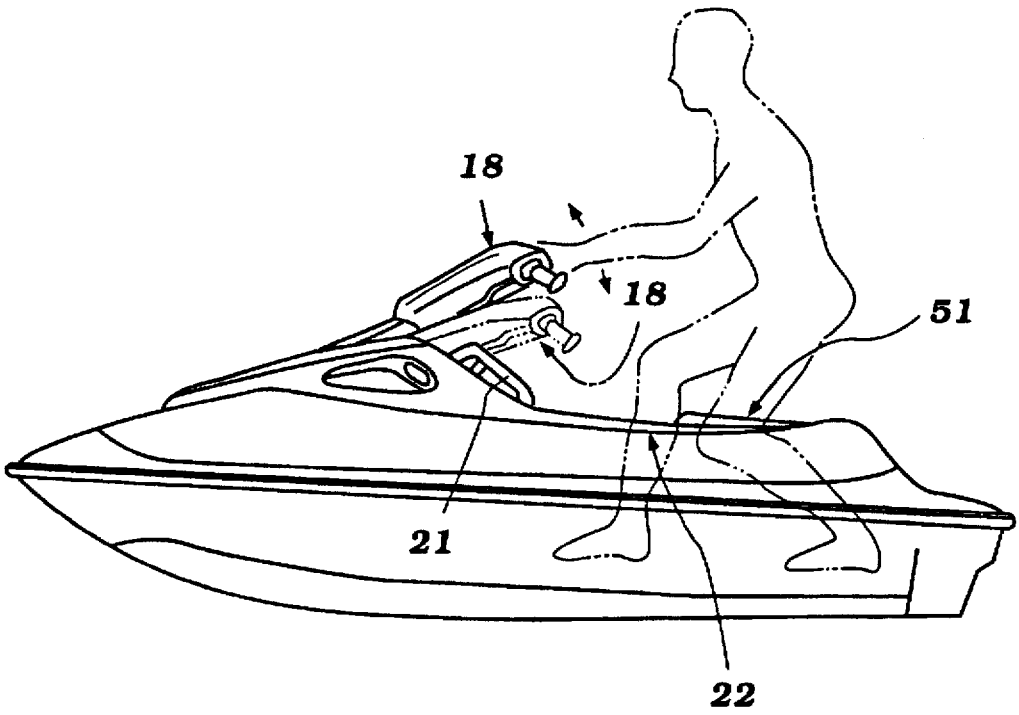
FIG. 5 is a side elevational view similar to FIG. 4 but with the rider shown in a standing operating position.

Thus, it is readily apparent that the seat may be rigidly affixed to either the port or starboard sides of the rider's area 24. In this manner, the rider may control the watercraft from either a seated or standing position. If control is desired from a seated position, as seen in FIG. 4, the seat 51 is affixed at a first position behind the control assembly 18 in the starboard portion of the rider's area 24 with the rider's legs disposed in part beneath the control assembly 18 which is rotated downwardly to a lower position.

If, on the other hand, control is desired from a standing position, the seat 51 is affixed at a second position to the port side of the rider's area 24 with the control assembly 18 rotated upwardly to a higher position, allowing the rider to stand in the starboard side of the recess while operating the watercraft 11. With this configuration, the rider may also sit in the seat 51 when it is affixed on the port side of the rider's area 24 and still control the watercraft 11 since the watercraft 11 is dimensionally compact and the rider is still able to utilize the control mechanism 18 from this seated position and with the control assembly 18 once again in the lower position.

This arrangement also permits both the operator and a passenger to stand during watercraft operation. When this is done, the seat 51 is swung behind the grab rail 21 and the passenger may stand in front of the seat 51 and grasp the grab rail 21. Obviously the passenger may sit on the seat 51 if he desires.

This movement of the seat 51 also facilitates entering the riders' area from the rear deck 23. By moving the seat 51 to the solid line positions shown, the rider may more easily enter the riders' area, as should be readily apparent.

Figure 8:
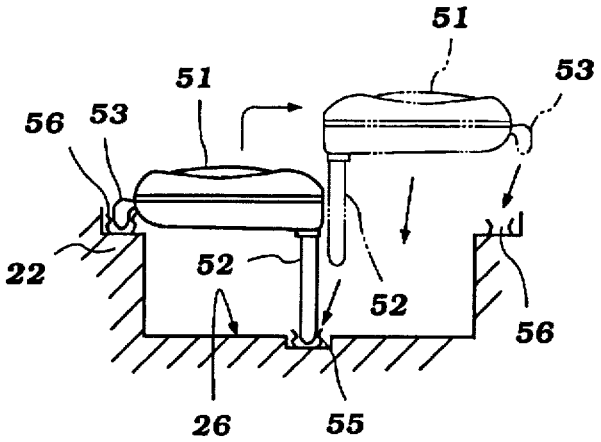
FIG. 8 is a rear elevational view similar to FIG. 6 and shows a further embodiment of the invention.
Figure 9:
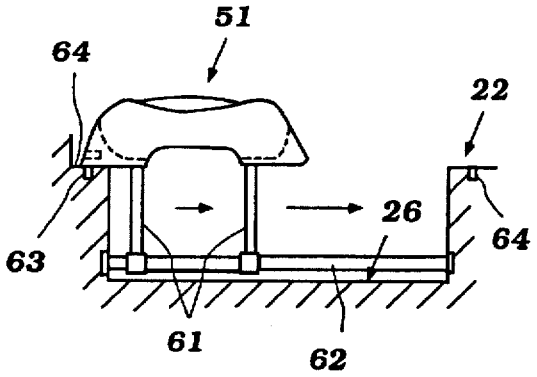
FIG. 9 is a rear elevational view similar to FIGS. 6 and 8 and shows a further embodiment of the invention.
Figure 10:
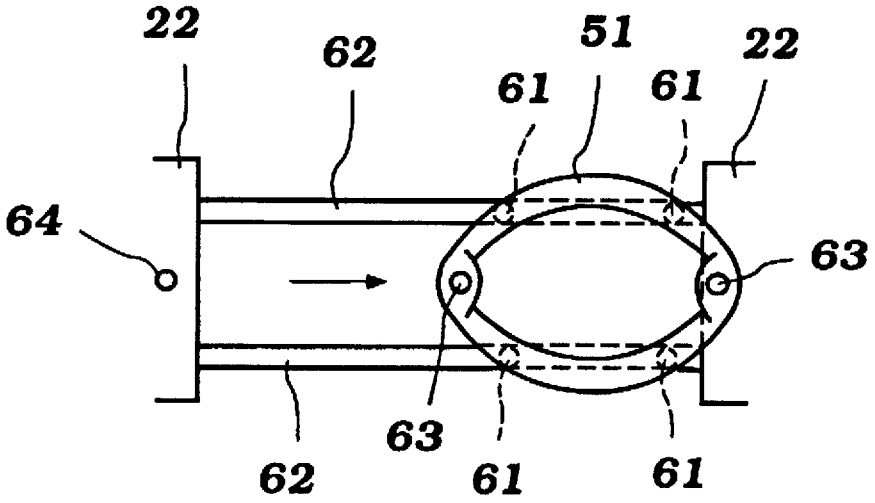
FIG. 10 is a top plan view of the embodiment of FIG. 9.

The seat 51 may be mounted in the rider's area 24 in a variety of manners as is seen in FIGS. 8, 9 and 10. In the system illustrated in FIG. 8, the basic functionality is identical to the embodiments shown in FIGS. 1 and 6 but the bracket 53 has been significantly reduced in size and now connects the seat 51 to outstanding portions of the gunnels 22. In the embodiment illustrated in FIG. 8, the mast 52 is rigidly affixed to the seat 51 and detachably connected to the rider's area 24 by a tension clamp 55 mounted at the rearward portion of the floor 26 along the longitudinal center line. Additional tension clamps 56 are mounted to the upstanding wall portions of the gunnels 22 and constrain the seat bracket 52 in a detachable manner. Thus, it is readily apparent that the seat 51 can be easily picked up, reversed and affixed to the desired side of the rider's area 24 both quickly and securely without the use of any tools.

A further embodiment of the invention is shown in FIGS. 9 and 10 in which the seat 51 rests on four legs 61 which, in turn, slidingly engage a parallel transverse pair of guide rails 62 with the two forward legs engaging the leading rail while the rearward legs engage the trailing rail. The rails 62 extend transversely across the bottom of the rearmost portion of the rider's area 24 and are affixed at their ends to the gunnels 22 at a location slightly above the floor 26. The seat 51 may be slid along the rails 62 to the desired side of the rider's area 24 and then constrained by means of a locking key (not shown) which is positioned through a hole 63 located at the edge of the seat 51 and into a receiving hole 64 in the upstanding wall portions of the gunnel 22.

It should be readily apparent from the foregoing description that the described embodiments are very effective in meeting the objectives as set forth. Of course, various changes and modifications may be made without departing from the spirit and scope of the invention as defined by the appended claims.

What is claimed is:

1. A small watercraft comprised of a hall defining a riders' area, a control for said watercraft on one side of and at the front of said riders' area, said control being mounted at the rear end of a mast extending from a position in said hall forward of said riders' area into said riders' area, said mast being pivotally connected at its forward end to said hull about a horizontally extending axis, said control being arranged for operation of said small watercraft by an operator from either a standing or seated position behind said control, a grab rail fixed to said hull on the other side of and to the front of said riders' area and to the rear of said horizontally extending axis and forwardly of said control for grasping by a passenger standing to the side of the operator.

2. A small watercraft as set forth in claim 1, wherein a seat is provided in said riders' area at least behind said grab rail and a foot area is provided in front of said seat to accommodate the standing passenger.

3. A small watercraft comprised of a hull defining a riders' area, a control for said watercraft on one side of and at the front of said riders' area, said control being mounted at the rear end of a mast extending from a position in said hull forward of said riders' area into said riders' area, said mast being pivotally connected at its forward end to said hull about a horizontally extending axis, said control being arranged for operation of said small watercraft by an operator from either a standing or seated position behind said control, a grab rail fixed to said hull on the other side of and to the front of said riders' area and to the rear of said horizontally extending axis and forwardly of said control for grasping by a passenger standing to the side of the operator, wherein a seat is provided in said riders' area at least behind said grab rail and a foot area is provided in front of said seat to accommodate the standing passenger, said seat being moveable from a position behind said grab rail to a position behind said control.

4. A small watercraft as set forth in claim 3, wherein the seat is pivotal between the first and second positions.

5. A small watercraft as set forth in claim 4, wherein the pivotal axis of the seat is a vertical pivotal axis disposed at one side of the seat and in the center of the riders' area.

6. A small watercraft as set forth in claim 5, wherein the control is accessible in either position of the seat so that the rider may operate the control when seated in either seat position.

7. A small watercraft as set forth in claim 3, wherein the seat is detachably supported in the riders' area for its positioning in either of a first and second position.

8. A small watercraft as set forth in claim 7, wherein the seat has a first portion adapted to engage a portion of an upstanding wall of the riders' area for vertical support of that side of the seat and an extending leg adapted to engage the floor for support on the floor at that side of the seat and when the seat is reversible when moved between its first and second positions.

9. A small watercraft as set forth in claim 3, wherein the seat is slidably supported between the positions.

10. A small watercraft as set forth in claim 9, wherein the seat is slidably supported on at least one guide rail positioned in the riders' area.

11. A small watercraft as set forth in claim 3 wherein the riders' area is generally open and surrounded on at least three sides by an upstanding wall with the floor of said riders' area disposed substantially below the upper ends of said wall.

12. A small watercraft as set forth in claim 11, wherein a rider seated on the seat in its position behind the controls has his legs extending at least in part beneath the mast.

13. A small watercraft as set forth in claim 12, further including a deck area formed behind the wall at the rear of the riders' area onto which a rider may board the watercraft from a body of water in which the watercraft is operated.

14. A small watercraft as set forth in claim 13, wherein the seat is pivotal between the positions.

15. A small watercraft as set forth in claim 14, wherein the seat is pivotal about a vertical pivotal axis disposed at one side of the seat and in the center of the rides' area.

16. A small watercraft as set forth in claim 15, wherein the control is accessible in either position of the seat so that the rider may operate the control when seated in either seat position.

17. A small watercraft as set forth in claim 13, wherein the seat is detachably supported in the passengers' compartment for its positioning in either of the positions.

18. A small watercraft as, set forth in claim 17, wherein the seat has a first portion adapted to engage a portion of the upstanding wall for vertical support of that side of the seat and an extending leg adapted to engage the floor for support on the floor at that side of the seat and when the seat is reversible when moved between its positions.

19. A small watercraft as set forth in claim 13, wherein the seat is slidably supported between the positions.

20. A small watercraft as set forth in claim 19, wherein the seat is slidably supported on at least one guide rail positioned in the riders' area.

* * * * *

UNITED STATES PATENT AND TRADEMARK OFFICE

CERTIFICATE OF CORRECTION

PATENT NO. : 5,697,318
DATED : December 16, 1997
INVENTOR(S) : Kobayashi

It is certified that error appears in the above-identified patent and that said Letters Patent is hereby corrected as shown below:

Column 6,
Line 33, please change “the ride’s area” to -- the riders’ area --.

Signed and Sealed this

Third day of September, 2002

*Attest:*

*Attesting Officer*

JAMES E. ROGAN
*Director of the United States Patent and Trademark Office*